US010670314B2

(12) United States Patent
Wei et al.

(10) Patent No.: US 10,670,314 B2
(45) Date of Patent: Jun. 2, 2020

(54) REFRIGERATION SYSTEM

(71) Applicant: DANFOSS MICRO CHANNEL HEAT EXCHANGER (JIAXING) CO., LTD., Zhejiang (CN)

(72) Inventors: Wenjian Wei, Zhejiang (CN); Xiangxun Lu, Zhejiang (CN); Zhifeng Zhang, Zhejiang (CN)

(73) Assignee: DANFOSS MICRO CHANNEL HEAT EXCHANGER (JIAXING) CO., LTD, Zhejiang (CN)

( * ) Notice: Subject to any disclaimer, the term of this patent is extended or adjusted under 35 U.S.C. 154(b) by 141 days.

(21) Appl. No.: 15/772,158

(22) PCT Filed: Aug. 11, 2016

(86) PCT No.: PCT/CN2016/094606
§ 371 (c)(1),
(2) Date: Apr. 30, 2018

(87) PCT Pub. No.: WO2017/080268
PCT Pub. Date: May 18, 2017

(65) Prior Publication Data

US 2018/0313588 A1 Nov. 1, 2018

(30) Foreign Application Priority Data

Nov. 10, 2015 (CN) ..... 2015 1 0761650

(51) Int. Cl.
*F25B 41/00* (2006.01)
*F25B 43/00* (2006.01)
(Continued)

(52) U.S. Cl.
CPC ..... *F25B 41/003* (2013.01); *F25B 39/028* (2013.01); *F25B 39/04* (2013.01);
(Continued)

(58) Field of Classification Search
CPC ..... F25B 41/003; F25B 39/028; F25B 39/04; F25B 40/00; F25B 41/04; F25B 41/062; F25B 43/006
See application file for complete search history.

(56) References Cited

U.S. PATENT DOCUMENTS 4,190,105 A * 2/1980 Dankowski ..... B60H 1/3227 138/38
8,763,424 B1 * 7/2014 Albertson ..... F25B 39/028 62/498

(Continued)

FOREIGN PATENT DOCUMENTS

CN 202361527 U 8/2012
CN 103528284 A 1/2014

(Continued)

OTHER PUBLICATIONS

Supplementary European Search Report for U.S. Appl. No. 16/863,446 dated Jul. 2, 2019.

(Continued)

*Primary Examiner* — Ana M Vazquez
(74) *Attorney, Agent, or Firm* — McCormick, Paulding & Huber PLLC

(57) ABSTRACT

Disclosed in the present invention is a refrigeration system, comprising: an evaporator and a condenser connected by a pipeline, wherein: at least one of the evaporator and the condenser comprises a heat exchange tube, the heat exchange tube comprising a first channel and a second channel, and the first channel and the second channel of the heat exchange tube forming different flow paths of the refrigeration system.

17 Claims, 3 Drawing Sheets

(51) Int. Cl.

| | |
|---|---|
| ***F25B 40/00*** | (2006.01) |
| ***F25B 39/02*** | (2006.01) |
| ***F25B 39/04*** | (2006.01) |
| ***F25B 41/04*** | (2006.01) |
| ***F25B 41/06*** | (2006.01) |

(52) U.S. Cl.
CPC ..... *F25B 40/00* (2013.01); *F25B 41/04* (2013.01); *F25B 41/062* (2013.01); *F25B 43/006* (2013.01)

(56) References Cited

U.S. PATENT DOCUMENTS

| | | | | |
|---|---|---|---|---|
| 2006/0288721 | A1* | 12/2006 | Tsuboi | F25B 9/008 62/239 |
| 2007/0169508 | A1* | 7/2007 | Ichiyanagi | F25D 23/003 62/498 |
| 2008/0041092 | A1* | 2/2008 | Gorbounov | F25B 39/02 62/498 |
| 2012/0192589 | A1 | 8/2012 | Omer | |
| 2014/0260364 | A1* | 9/2014 | Litch | F25B 39/02 62/82 |
| 2016/0290730 | A1* | 10/2016 | Taras | F28D 1/0435 |

FOREIGN PATENT DOCUMENTS

| | | | |
|---|---|---|---|
| CN | 103743156 | A | 4/2014 |
| JP | 4671985 | B2 | 4/2011 |
| JP | 2014132217 | A | 7/2014 |
| JP | 2014194313 | A | 10/2015 |
| KR | 200408008 | Y1 | 2/2006 |
| KR | 20120111634 | A | 10/2012 |
| WO | 2012046947 | A1 | 4/2012 |
| WO | 2013140992 | A1 | 9/2013 |

OTHER PUBLICATIONS

International Search Report for PCT Serial No. PCT/CN2016/094606 dated Aug. 11, 2016.

* cited by examiner

REFRIGERATION SYSTEM

CROSS-REFERENCE TO RELATED APPLICATIONS

This application is a National Stage application of International Patent Application No. PCT/CN2016/094606, filed on Aug. 11, 2016, which claims priority to Chinese Patent Application No. 201510761650.2, filed on Nov. 10, 2015, each of which is hereby incorporated by reference in its entirety.

TECHNICAL FIELD

An embodiment of the present invention relates to a refrigeration system.

BACKGROUND

In an existing refrigeration system, heat exchange tubes of an evaporator and a condenser are generally hollow round tubes or flat tubes. A fluid in a single state flows through the same heat exchange tube, and although multiple heat exchange tubes can form and include multiple channels and thereby form different flow paths, there is an equivalent parallel-connection relationship among the multiple flow path channels, and the states of fluids entering the channels are substantially the same. Merely serving as the same flow path.

SUMMARY

An object of an embodiment of the present invention is to provide a refrigeration system, whereby a system structure can for example be simplified.

An embodiment of the present invention provides a refrigeration system, comprising: an evaporator and a condenser connected by a pipeline, wherein: at least one of the evaporator and the condenser comprises a heat exchange tube, the heat exchange tube comprising a first channel and a second channel, and the first channel and the second channel of the heat exchange tube forming different flow paths of the refrigeration system.

According to an embodiment of the present invention, the refrigeration system further comprises: a compressor and an expansion valve, wherein: the evaporator comprises the heat exchange tube, the first channel of the heat exchange tube has a first port and a second port, the second channel of the heat exchange tube has a first port and a second port, and the condenser has a first port and a second port; the first port of the first channel of the heat exchange tube is connected to the second port of the condenser, the expansion valve is connected between the second port of the first channel of the heat exchange tube and the first port of the second channel of the heat exchange tube, and the second port of the second channel of the heat exchange tube is connected to an inlet of the compressor.

According to an embodiment of the present invention, the first port of the condenser is connected to an outlet of the compressor.

According to an embodiment of the present invention, the first port of the first channel of the heat exchange tube and the second port of the second channel of the heat exchange tube are located at the same end of the heat exchange tube.

According to an embodiment of the present invention, the refrigeration system further comprises: a compressor, wherein: the condenser comprises the heat exchange tube, the first channel of the heat exchange tube has a first port and a second port, and the second channel of the heat exchange tube has a first port and a second port; the first port of the first channel of the heat exchange tube is closed, and the second port of the first channel of the heat exchange tube is in communication with the second port of the second channel of the heat exchange tube, and the first port of the second channel of the heat exchange tube is connected to an outlet of the compressor.

According to an embodiment of the present invention, the refrigeration system further comprises: an expansion valve, wherein: the second port of the second channel of the heat exchange tube is connected to the expansion valve.

According to an embodiment of the present invention, the first port of the first channel of the heat exchange tube and the first port of the second channel of the heat exchange tube are located at the same end of the heat exchange tube.

According to an embodiment of the present invention, the refrigeration system further comprises: a compressor, wherein: the evaporator comprises the heat exchange tube, the first channel of the heat exchange tube has a first port and a second port, and the second channel of the heat exchange tube has a first port and a second port; the refrigeration system further comprises a gas-liquid separator, the gas-liquid separator having a first port for inflowing refrigerant, a second port for outflowing gaseous refrigerant, and a third port for outflowing liquid refrigerant; the second port of the gas-liquid separator is connected to the first port of the first channel of the heat exchange tube, and the third port of the gas-liquid separator is connected to the first port of the second channel of the heat exchange tube, and the second port of the first channel and the second port of the second channel of the heat exchange tube are connected to an inlet of the compressor.

According to an embodiment of the present invention, the refrigeration system further comprises: a bypass tube connecting the first port and the second port of the first channel of the heat exchange tube.

According to an embodiment of the present invention, the refrigeration system further comprises: a control valve disposed on the bypass tube, for controlling a flow rate of gaseous refrigerant passing through the bypass tube.

According to an embodiment of the present invention, the refrigeration system further comprises: an expansion valve, wherein: the first port of the gas-liquid separator is connected to an outlet of the expansion valve.

According to an embodiment of the present invention, the first port of the first channel of the heat exchange tube and the first port of the second channel of the heat exchange tube are located at the same end of the heat exchange tube.

According to an embodiment of the present invention, the first channel and the second channel are disposed side by side.

According to an embodiment of the present invention, the first channel is a central channel, and the second channel is a peripheral channel surrounding the central channel.

According to an embodiment of the present invention, the first channel is a central channel, and the second channel is multiple peripheral channels surrounding the central channel.

By using the refrigeration system according to an embodiment of the present invention, it is possible for example to simplify the system structure, reduce system costs, and increase system efficiency.

DETAILED DESCRIPTION

The present invention is described in further detail below with reference to the accompanying drawings and embodiments. The embodiments below are intended to explain the present invention, but not to restrict the scope thereof.

Figure 1:
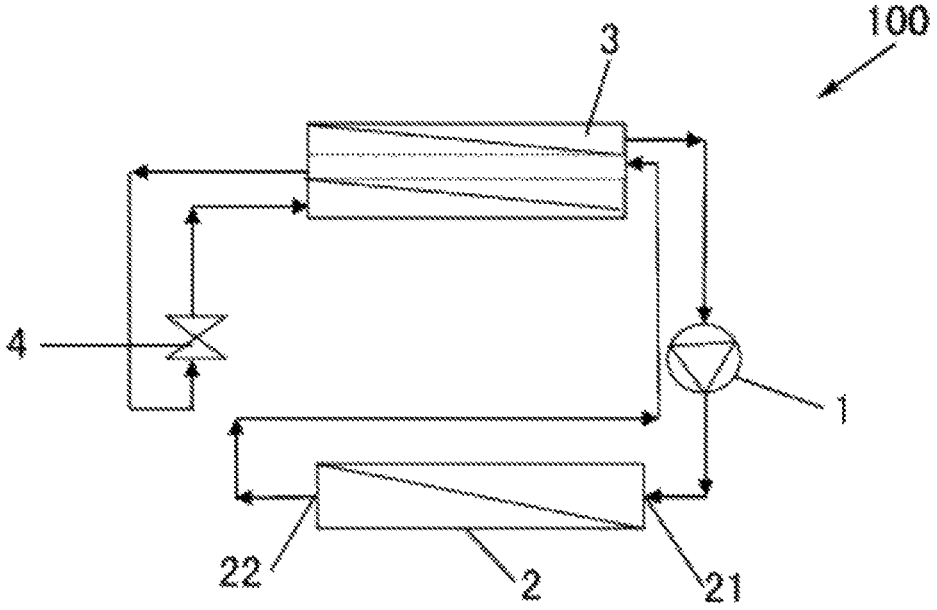
FIG. 1 is a schematic diagram of a refrigeration system according to a first embodiment of the present invention.
Figure 3:
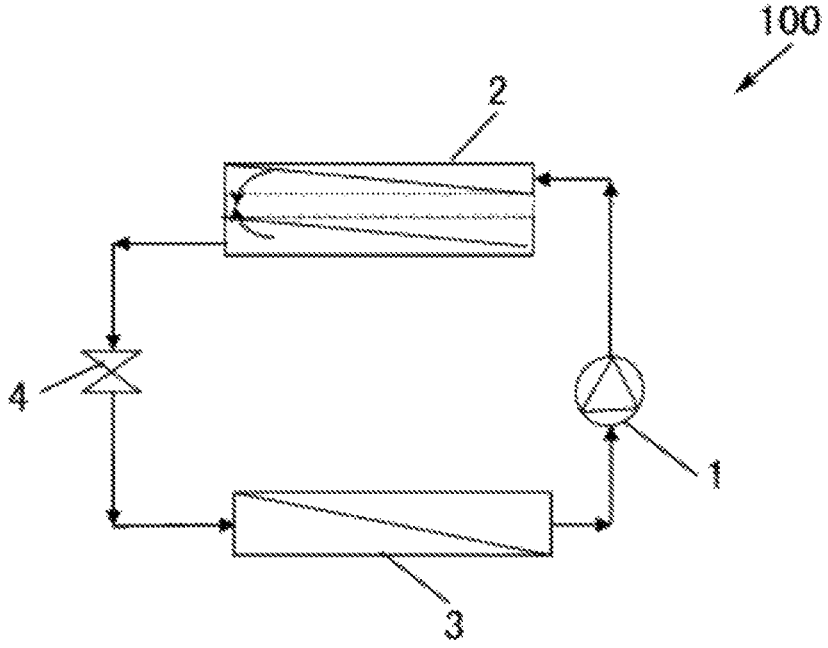
FIG. 3 is a schematic diagram of a refrigeration system according to a second embodiment of the present invention.
Figure 5:
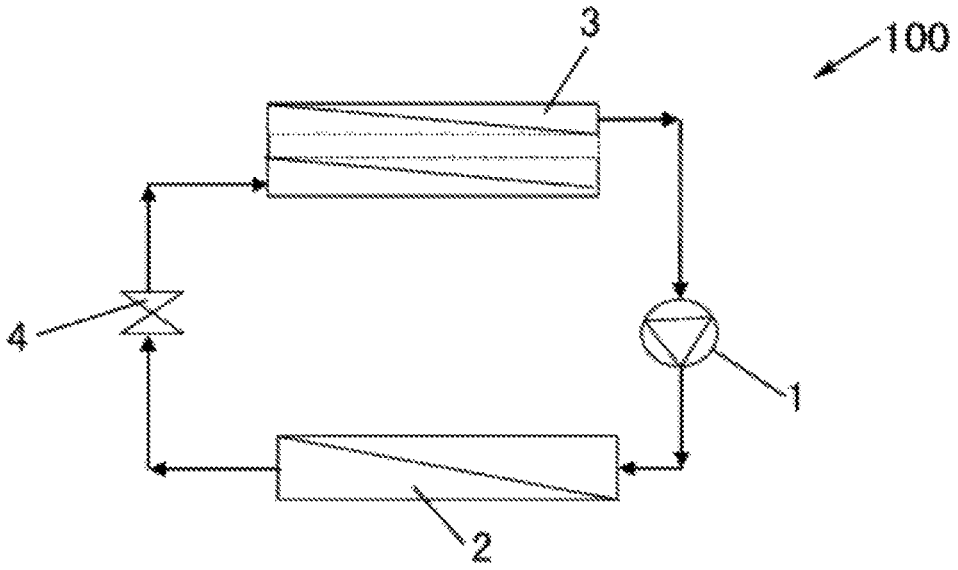
FIG. 5 is a schematic diagram of a refrigeration system according to a third embodiment of the present invention.

As shown in FIGS. 1, 3 and 5, a refrigeration system 100 according to an embodiment of the present invention comprises: a compressor 1, a condenser 2, an evaporator 3, an expansion valve 4 and pipelines connecting the abovementioned components.

As shown in FIGS. 1 to 6, the evaporator 3 and condenser 2 comprise a fin 31, at least one of the evaporator 3 and condenser 2 comprises a heat exchange tube 32, the heat exchange tube 32 comprises a central channel 321 and multiple peripheral channels 322 surrounding the central channel 321, and the central channel 321 and peripheral channels 322 of the heat exchange tube 32 form different flow paths of the refrigeration system.

Figure 2:
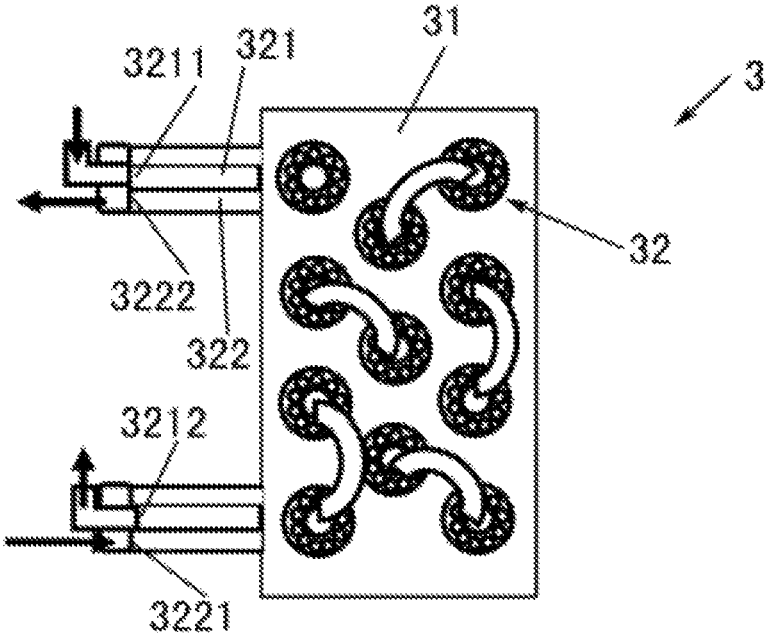
FIG. 2 is a schematic diagram of an evaporator according to the first embodiment of the present invention.

As shown in FIGS. 1 and 2, in some embodiments of the present invention, the evaporator 3 comprises the heat exchange tube 32, the central channel 321 of the heat exchange tube 32 has a first port 3211 and a second port 3212, the peripheral channel 322 of the heat exchange tube 32 has a first port 3221 and a second port 3222, and the condenser 2 has a first port 21 and a second port 22; the first port 3211 of the central channel 321 of the heat exchange tube 32 is connected to the second port 22 of the condenser 2, the expansion valve 4 is connected between the second port 3212 of the central channel 321 of the heat exchange tube 32 and the first port 3221 of the peripheral channel 322 of the heat exchange tube 32, and the second port 3222 of the peripheral channel 322 of the heat exchange tube 32 is connected to an inlet of the compressor 1. The first port 21 of the condenser 2 may be connected to an outlet of the compressor 1. As shown in FIG. 2, the first port 3211 of the central channel 321 of the heat exchange tube 32 and the second port 3222 of the peripheral channel 322 of the heat exchange tube 32 are located at the same end (one end) of the heat exchange tube 32. In addition, the second port 3212 of the central channel 321 of the heat exchange tube 32 and the first port 3221 of the peripheral channel 322 of the heat exchange tube 32 are located at the same end (another end) of the heat exchange tube 32.

According to an embodiment of the present invention, the central channel 321 may be used as a subcooler, and refrigerant from the condenser may flow through the central channel 321.

Figure 4:
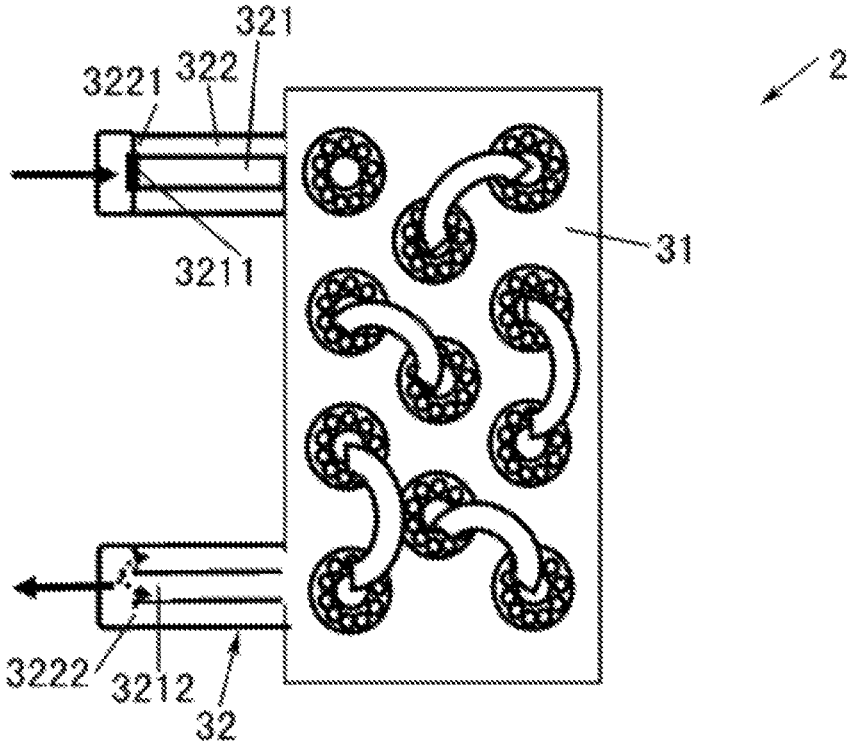
FIG. 4 is a schematic diagram of a condenser according to the second embodiment of the present invention.

As shown in FIGS. 3 and 4, in some embodiments of the present invention, the condenser 2 comprises the heat exchange tube 32, the central channel 321 of the heat exchange tube 32 has a first port 3211 and a second port 3212, and the peripheral channel 322 of the heat exchange tube 32 has a first port 3221 and a second port 3222; the first port 3211 of the central channel 321 of the heat exchange tube 32 is closed, and the second port 3212 of the central channel 321 of the heat exchange tube 32 is in communication with the second port 3222 of the peripheral channel 322 of the heat exchange tube 32; moreover, the first port 3221 of the peripheral channel 322 of the heat exchange tube 32 is connected to the outlet of the compressor 1. As shown in FIG. 4, the first port 3211 of the central channel 321 of the heat exchange tube 32 and the first port 3221 of the peripheral channel 322 of the heat exchange tube 32 are located at the same end (one end) of the heat exchange tube 32. In addition, the second port 3212 of the central channel 321 of the heat exchange tube 32 and the second port 3222 of the peripheral channel 322 of the heat exchange tube 32 are located at the same end (another end) of the heat exchange tube 32. As shown in FIG. 3, the second port 3222 of the peripheral channel 322 of the heat exchange tube 32 may be connected to the expansion valve 4.

According to an embodiment of the present invention, the central channel 321 may be used as a refrigerant storage device, and refrigerant from the condenser may flow through the central channel 321.

Figure 6:
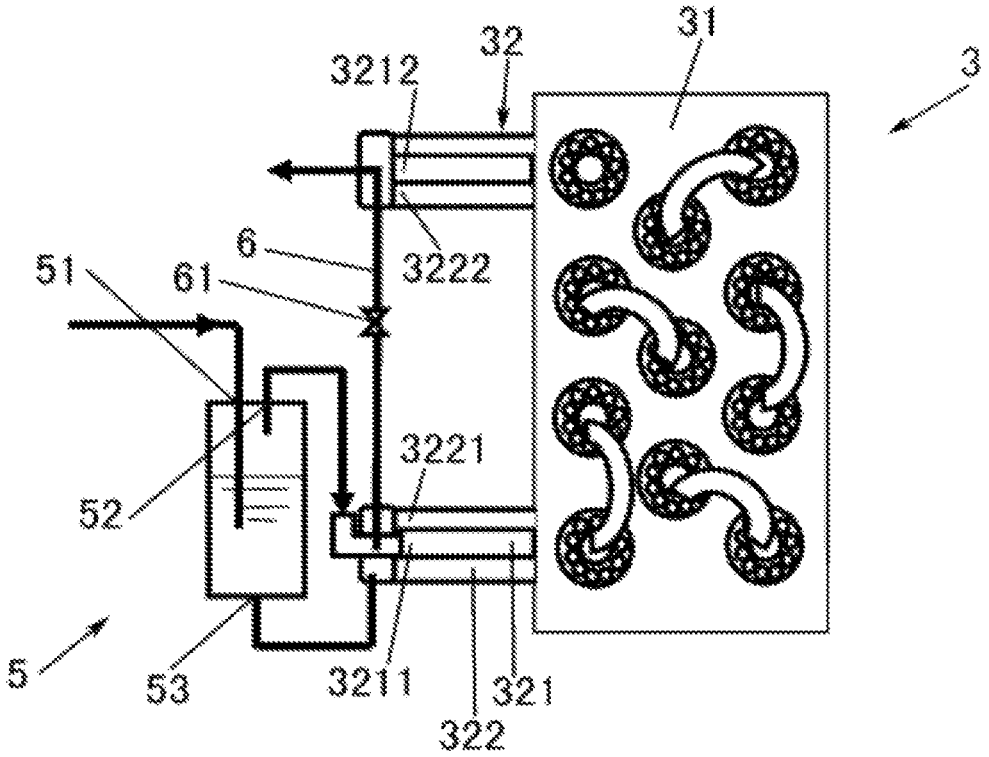
FIG. 6 is a schematic diagram of an evaporator and a gas-liquid separator according to the third embodiment of the present invention.

As shown in FIGS. 5 and 6, in some embodiments of the present invention, the evaporator 3 comprises the heat exchange tube 32, the central channel 321 of the heat exchange tube 32 has a first port 3211 and a second port 3212, and the peripheral channel 322 of the heat exchange tube 32 has a first port 3221 and a second port 3222; the refrigeration system 100 may also comprise a gas-liquid separator 5, the gas-liquid separator 5 having a first port 51 for inflowing refrigerant, a second port 52 for outflowing gaseous refrigerant, and a third port 53 for outflowing liquid refrigerant; the second port 52 of the gas-liquid separator 5 is connected to the first port 3211 of the central channel 321 of the heat exchange tube 32, and the third port 53 of the gas-liquid separator 5 is connected to the first port 3221 of the peripheral channel 322 of the heat exchange tube 32; moreover, the second port 3212 of the central channel 321 and the second port 3222 of the peripheral channel 322 of the heat exchange tube 32 are connected to the inlet of the compressor 1. As shown in FIG. 6, the refrigeration system 100 may also comprise: a bypass tube 6 connecting the first port 3211 and the second port 3212 of the central channel 321 of the heat exchange tube 32. The refrigeration system 100 may also comprise: a control valve 61 disposed on the bypass tube 6, for controlling a flow rate of gaseous refrigerant passing through the bypass tube 6. The first port 51 of the gas-liquid separator 5 may be connected to an outlet of the expansion valve 4. As shown in FIG. 6, the first port 3211 of the central channel 321 of the heat exchange tube 32 and the first port 3221 of the peripheral channel 322 of the heat exchange tube 32 are located at the same end (one end) of the heat exchange tube 32. In addition, the second port 3212 of the central channel 321 of the heat exchange tube 32 and the second port 3222 of the peripheral channel 322 of the heat exchange tube 32 are located at the same end (another end) of the heat exchange tube 32.

According to an embodiment of the present invention, by using the gas-liquid separator 5 to separate vapour and liquid phases of refrigerant, uniform distribution of refrigerant flowing through the heat exchange tube can be achieved more effectively, thereby increasing heat exchanger efficiency. The entry of liquid refrigerant into the compressor can be avoided. In addition, the use of the control valve enables the amounts of gaseous refrigerant bypassing and flowing through the heat exchanger to be controlled, to reduce a refrigerant pressure drop of gaseous refrigerant caused by passage through the heat exchanger to within an acceptable range.

In the case of a conventional air conditioning system, in order to increase system efficiency, avoid liquid being carried in gas drawn by the compressor and at the same time increase supercooling, it is necessary to provide an additional indraft pipeline heat exchanger suction regenerator. In the system according to an embodiment of the present invention, by guiding liquid refrigerant to flow into the central channel, and guiding gaseous and liquid phases of refrigerant to flow into the peripheral channel, the objectives of suction regeneration and liquid refrigerant supercooling are achieved, and an indraft pipeline heat exchange gas regenerator can be omitted.

In the case of a refrigeration system having heating and cooling modes, an apparatus for accommodating excess refrigerant must be provided, because the two modes require different amounts of refrigerant. In the system according to an embodiment of the present invention, excess refrigerant can be stored in the central channel of the condenser. Therefore, it is not necessary to provide an apparatus for accommodating excess refrigerant.

Thus, the refrigeration system according to the present invention is compact in structure, has high efficiency, requires a small amount of refrigerant, and has low costs.

In the refrigeration system according to the present invention, at least one of the evaporator 3 and the condenser 2 comprises the heat exchange tube 32, so at least one of the evaporator 3 and the condenser 2 can form two refrigerant loops or refrigerant flow paths.

Although the heat exchange tube 32 comprises the central channel 321 and the multiple peripheral channels 322 surrounding the central channel 321 in the embodiments above, the heat exchange tube 32 may also comprise arbitrary first and second channels, e.g. one or more first channel(s) and second channel(s); the first channel and second channel may be disposed side by side. In the case of the embodiments above, the first channel is the central channel, and the second channel is the multiple peripheral channels surrounding the central channel. In addition, the peripheral channel may also be one channel.

The embodiments above are merely intended to explain the present invention, without limiting it. Those skilled in the art could make various changes and alterations in form without departing from the spirit and scope of the present invention. Thus, all equivalent technical solutions also fall within the scope of the present invention, and the scope of patent protection of the present invention shall be defined by the claims.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A refrigeration system, comprising:

an evaporator and a condenser connected by a pipeline, and a compressor, wherein the evaporator comprises a heat exchange tube, the heat exchange tube comprising a first channel and a second channel, and the first channel and the second channel of the heat exchange tube form different flow paths of the refrigeration system, wherein the first channel of the heat exchange tube has a first port and a second port, the second channel of the heat exchange tube has a first port and a second port, and the condenser has a first port and a second port, wherein the first port of the first channel of the heat exchange tube is connected to the second port of the condenser, wherein an expansion valve is connected between the second port of the first channel of the heat exchange tube and the first port of the second channel of the heat exchange tube, and wherein the second port of the second channel of the heat exchange tube is connected to an inlet of the compressor.

2. The refrigeration system as claimed in claim 1, wherein the first port of the condenser is connected to an outlet of the compressor.

3. The refrigeration system as claimed in claim 1, wherein the first port of the first channel of the heat exchange tube and the second port of the second channel of the heat exchange tube are located at the same end of the heat exchange tube.

4. The refrigeration system as claimed in claim 1, wherein the first channel and the second channel are disposed side by side.

5. The refrigeration system as claimed in claim 1, wherein the first channel is a central channel, and the second channel is a peripheral channel surrounding the central channel.

6. The refrigeration system as claimed in claim 1, wherein the first channel is a central channel, and the second channel is multiple peripheral channels surrounding the central channel.

7. A refrigeration system, comprising:

an evaporator and a condenser connected by a pipeline, a compressor, wherein the condenser comprises a heat exchange tube, the heat exchange tube comprising a first channel and a second channel, and the first channel and the second channel of the heat exchange tube form different flow paths of the refrigeration system, wherein the first channel of the heat exchange tube has a first port and a second port, and the second channel of the heat exchange tube has a first port and a second port, wherein the first port of the first channel of the heat exchange tube is closed, and the second port of the first channel of the heat exchange tube is in communication with the second port of the second channel of the heat exchange tube, and wherein the first port of the second channel of the heat exchange tube is connected to an outlet of the compressor.

8. The refrigeration system as claimed in claim 7, further comprising:

an expansion valve, wherein the second port of the second channel of the heat exchange tube is connected to the expansion valve.

9. The refrigeration system as claimed in claim 7, wherein the first port of the first channel of the heat exchange tube and the first port of the second channel of the heat exchange tube being located at the same end of the heat exchange tube.

10. The refrigeration system as claimed in claim 7, wherein the first channel and the second channel are disposed side by side.

11. The refrigeration system as claimed in claim 7, wherein the first channel is a central channel, and the second channel is a peripheral channel surrounding the central channel.

12. The refrigeration system as claimed in claim 7, wherein the first channel is a central channel, and the second channel is multiple peripheral channels surrounding the central channel.

13. A refrigeration system, comprising:

an evaporator and a condenser connected by a pipeline, and a compressor, wherein the evaporator comprises a heat exchange tube, the heat exchange tube comprising a first channel and a second channel, and the first channel and the second channel of the heat exchange tube form different flow paths of the refrigeration system, wherein the first channel of the heat exchange tube has a first port and a second port, and the second channel of the heat exchange tube has a first port and a second port, wherein the refrigeration system further comprises a gas-liquid separator, the gas-liquid separator having a first port for inflowing refrigerant, a second port for outflowing gaseous refrigerant, and a third port for outflowing liquid refrigerant, wherein the second port of the gas-liquid separator is connected to the first port of the first channel of the heat exchange tube, and the third port of the gas-liquid separator is connected to the first port of the second channel of the heat exchange tube, and wherein the second port of the first channel and the second port of the second channel of the heat exchange tube are connected to an inlet of the compressor.

14. The refrigeration system as claimed in claim 13, further comprising:

a bypass tube connecting the first port and the second port of the first channel of the heat exchange tube.

15. The refrigeration system as claimed in claim 14, further comprising:

a control valve disposed on the bypass tube, for controlling a flow rate of gaseous refrigerant passing through the bypass tube.

16. The refrigeration system as claimed in claim 14, further comprising:

an expansion valve, wherein the first port of the gas-liquid separator is connected to an outlet of the expansion valve.

17. The refrigeration system as claimed in claim 13, wherein the first port of the first channel of the heat exchange tube and the first port of the second channel of the heat exchange tube are located at the same end of the heat exchange tube.

* * * * *